US008530775B2

(12) United States Patent
Gentsch

(10) Patent No.: US 8,530,775 B2
(45) Date of Patent: Sep. 10, 2013

(54) POLE PART OF A MEDIUM-VOLTAGE SWITCHING DEVICE

(75) Inventor: Dietmar Gentsch, Ratingen (DE)

(73) Assignee: ABB Technology AG, Zurich (CH)

( * ) Notice: Subject to any disclaimer, the term of this patent is extended or adjusted under 35 U.S.C. 154(b) by 270 days.

(21) Appl. No.: 12/751,024

(22) Filed: Mar. 31, 2010

(65) Prior Publication Data

US 2010/0181291 A1 Jul. 22, 2010

Related U.S. Application Data

(63) Continuation of application No. PCT/EP2007/008539, filed on Oct. 2, 2007.

(51) Int. Cl.
*H01H 33/66* (2006.01)

(52) U.S. Cl.
USPC ..... 218/134; 218/120; 218/140

(58) Field of Classification Search
USPC ..... 218/118–121, 134, 136, 140, 153–155
See application file for complete search history.

(56) References Cited

U.S. PATENT DOCUMENTS

| | | | | |
|---|---|---|---|---|
| 4,497,377 | A * | 2/1985 | Haytayan | 173/15 |
| 5,321,221 | A * | 6/1994 | Rozier | 218/2 |
| 7,115,831 | B2 * | 10/2006 | Chyla et al. | 218/124 |
| 2005/0092713 | A1 | 5/2005 | Chyla et al. | |

FOREIGN PATENT DOCUMENTS

| | | | |
|---|---|---|---|
| DE | 298 25 094 | U1 | 10/2004 |
| WO | WO 03/071567 | A1 | 8/2003 |

OTHER PUBLICATIONS

International Search Report for PCT/EP2007/008539 completed Jun. 6, 2008.

International Preliminary Report on Patentability (Form PCT/IB/373) and the Written Opinion of the International Searching Authority (Form PCT/ISA/237) issued in corresponding International Application No. PCT/EP2007/008539 dated Apr. 7, 2010.

* cited by examiner

*Primary Examiner* — Amy Cohen Johnson
*Assistant Examiner* — Marina Fishman
(74) *Attorney, Agent, or Firm* — Buchanan Ingersoll & Rooney

(57) ABSTRACT

The present disclosure provides a pole part of a low-voltage, medium-voltage and/or high-voltage switching device. The pole part includes a vacuum interrupter chamber having a fixed contact and a movable contact, which includes an electrical contact piece. The vacuum interrupt chamber is cast into an insulating material. The insulating material has opening at the bottom in at least one of a region of the movable contact and a drive rod driving that drives the movable contact. To reduce the heating of the pole part to enable production of a higher rated current carrying capacity, in the region of the movable contact and/or the articulation point of the drive rod, at least one ventilation opening is formed to pass through at least one of an exterior wall of the insulation, a boundary zone between the insulation and the electrical connection piece, and the electrical connection piece.

20 Claims, 2 Drawing Sheets

POLE PART OF A MEDIUM-VOLTAGE SWITCHING DEVICE

RELATED APPLICATIONS

This application claims priority as a continuation application under 35 U.S.C. §120 to PCT/EP2007/008539 filed as an International Application on Oct. 2, 2007 designating the U.S., the entire content of which is hereby incorporated by reference in its entirety.

FIELD

The present disclosure relates to a pole part of a switching device having a vacuum interrupter chamber.

BACKGROUND INFORMATION

During operation of medium-voltage switchgear assemblies, heat is produced due to transfer resistances which limits the current carrying capacity in the region of the pole parts. Since the pole parts of the switching device are cast into insulating material, such as an epoxy resin or plastic, the dissipation of heat which can be achieved by convection is limited.

The current carrying capacity is therefore limited by the maximum permissible temperature that can occur without damaging the insulating material.

DE 298 25 094 U1 discloses a pole part of a medium-voltage switching device, in which a vacuum interrupter chamber is introduced into an epoxy resin encapsulation and is open on the base side, i.e. at the bottom. The proportionally largest electrical transfer resistance in the current path is produced for physical reasons substantially at the lower contact, i.e. at the movable contact. The heat produced there can substantially only be dissipated via heat conduction and hardly at all via convection. The insulating material epoxy resin is therefore a poor conductor of heat. Accordingly, it is difficult to dissipate heat that is produced in a medium-voltage switching device.

SUMMARY

An exemplary embodiment provides a pole part of a switching device. The exemplary pole part comprises a vacuum interrupter chamber having a fixed contact and a movable contact. The movable contact has an electrical connection piece. The exemplary pole part also comprises a drive rod configured to drive the movable contact of the vacuum interrupt chamber, and an insulating casing constituted by an insulating material into which the vacuum interrupt chamber is cast. The insulating casing has an opening at a bottom portion in at least one of a region of the movable contact and the drive rod. In addition, the exemplary pole part comprises at least one ventilation opening formed in at least one of the region of the movable contact and an articulation point of the drive rod. The at least one ventilation opening is formed to pass through at least one of a wall of the insulation casing, a boundary zone between the insulation casing and the electrical connection piece of the movable contact, and the electrical connection piece of the movable contact.

BRIEF DESCRIPTION OF THE DRAWINGS

Additional refinements, advantages and features of the present disclosure are described in more detail below with reference to exemplary embodiments illustrated in the drawing, in which.

DETAILED DESCRIPTION

Figure 1:
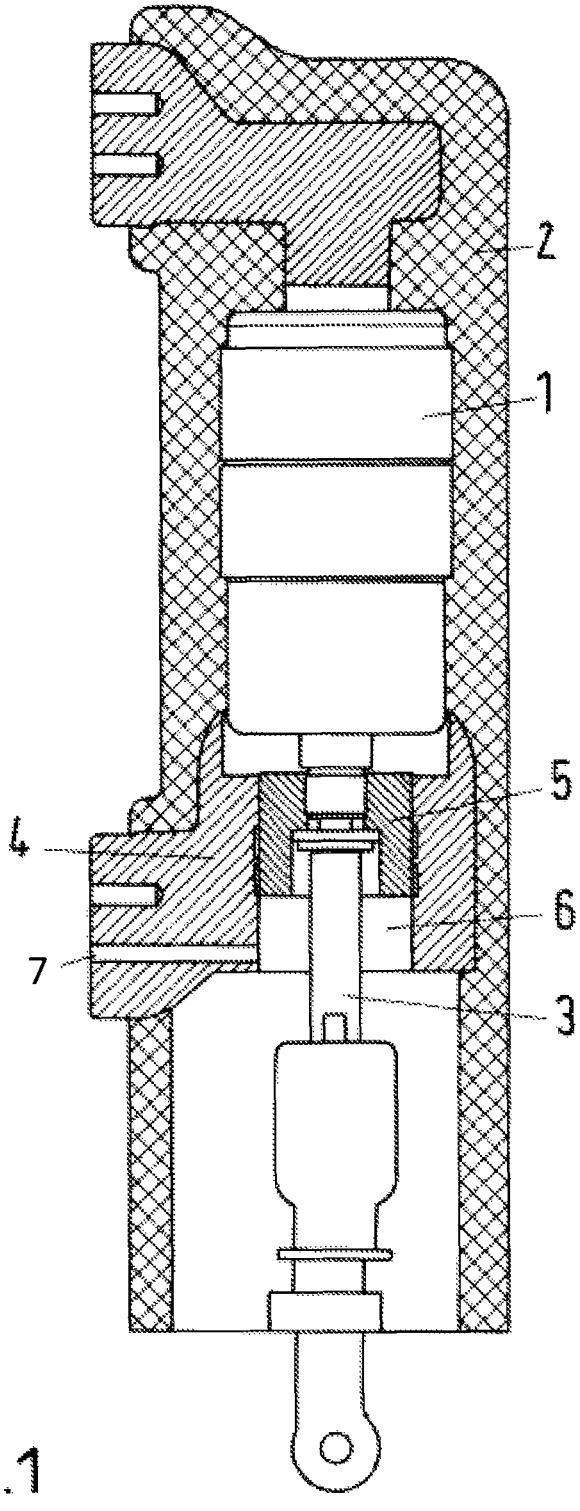
FIG. 1 shows a sectional illustration through an exemplary pole part according to a least one embodiment.

Exemplary embodiments of the present disclosure provide a pole part of a switching device in which the heating of the pole part is reduced to enable production of a higher rated current carrying capacity in the pole part.

Exemplary embodiments of the present disclosure provide that, in at least one of a region of a movable contact of a vacuum interrupt chamber and an articulation point of a drive rod that drives the movable contact, at least one ventilation opening is formed to pass through at least one of an exterior wall of an insulation casing into which the vacuum interrupt chamber is cast, a boundary zone between the insulation casing and an electrical connection piece of the movable contact, and the electrical connection piece of the movable contact. Via this ventilation opening, heat dissipation by means of convection can occur directly from the pole part casing. That is to say, air or gas can now flow in through the lower opening, i.e. the opening on the base side of the insulating casing of the pole part, and can escape outside the pole part through the ventilation hole directly close to the region of the produced heat for dissipation of the heat. As a result, a higher rated current carrying capacity of the pole part can be produced because there is no longer any buildup of heat, but instead the heat can be dissipated outside the pole part by means of convection.

Another exemplary embodiment provides that the ventilation opening extends substantially at right angles to an actuation axis of a drive axle of the movable contact. The ventilation opening can thus be applied with as short a channel length as possible, which favors the outflow of heated air or heated gas.

Another exemplary embodiment provides that a surface of the pole part has at least one of a predetermined amount of surface roughness and a rough structure for improved transport of heat towards the gas.

Another exemplary embodiment provides that an electrically conductive connection between the movable contact and the electrical connection piece is a movable electrical contact connection, which is provided via a piston, which is electrically and fixedly connected to the contact rod, and a drilled cylinder hole, which is applied in the connection piece, in the manner of a piston/cylinder arrangement. In this exemplary configuration, the ventilation opening can be formed directly below the lower opening stroke position of the piston. The ventilation or dissipation of heat can therefore occur directly in the region of the cause of the buildup of heat and therefore achieve maximum effectiveness of heat dissipation.

Another exemplary embodiment provides that the ventilation opening is formed in the region of an external connection plate of the electrical connection piece. In this way, the ventilation opening can be positioned at a favorable location in terms of manufacturing technology.

Another exemplary embodiment provides that the ventilation opening is formed in the electrical connection piece by means of at least one continuous hollow screw, which is configured to fix an external contact in the electrical connection piece. An accommodating opening of the at least one hollow screw passes continuously from outside of the pole part into an interior region of the pole part region to enable ventilation of the pole part. The use of hollow screws obviates the need for any special drilled holes to be applied.

Experiments have shown that, despite a possibly occurring increase in the resistance by, for example, 1 μΩ, the temperature at the same connection piece can be lowered by approximately 0.5 K. It is possible to deduce from this experiment that energy dissipated by this additional measure is approximately 10 W in the case of current impressed in a defined manner of around 3000 A. From the total resistance, it is possible to deduce that, both on the fixed-contact side and on the switching-contact side, heat of approximately 70 W can be dissipated. Owing to the introduction of drilled holes, approximately 14% more heat can be transferred from the pole part to the delivery. The cast resin component part remains unchanged, and heat dissipation occurs by means of convection from the inner region of the pole part, through the connection piece, into the surrounding environment.

Exemplary embodiments of the present disclosure are illustrated in the drawing and will be described in more detail below.

FIG. 1 shows a sectional illustration through an exemplary pole part according to at least one embodiment. In the pole part illustrated in FIG. 1, a vacuum interrupter chamber 1 is embedded in an insulating fashion, such as in an epoxy resin encapsulation 2, for example. The epoxy resin encapsulation 2 illustrated in FIG. 1 is an example of an encapsulating casing and/or insulating material constituting an insulating casing. An upper contact within the vacuum interrupter chamber 1 is fixed, while a lower contact within the vacuum interrupter chamber 1 is a movable contact. According to an exemplary embodiment, the movable contact of the vacuum interrupt chamber 1 can be passed outside of the vacuum interrupt chamber 1 via bellows, for example, and can be moved by a movable drive rod 3, which is configured to move a metallic piston 5 to cause the movement of the moving contact.

In order to create electrical transition (conduction) between the lower movable contact of the vacuum interrupt chamber 1 and an external connection point (connection piece) 4, a metallic electrically conductive connection is created between the movable contact and a metallic piston 5. The metallic piston 5 is configured to movably oscillate within a metallic electrically conductive cylinder area 6, which is also integrated in the metal body of the connection point 4. Outside at the connection point 4, an external contact is then made with a busbar. According to an exemplary embodiment, the ventilation opening 7 can be constituted by a drilled hole through the metal body of the connection point 4. In the exemplary embodiment illustrated in FIG. 1, the ventilation opening 7 is directly below the lowermost stroke position of the opened contact, i.e. below the piston 5.

According to an exemplary embodiment, the encapsulating casing 2 is open at the bottom. With this arrangement, air or gas can flow downwards and flow out again through the ventilation opening 7 to thereby dissipate heat. The opening of the encapsulating casing 2 and/or insulating material can be provided at the bottom of the encapsulating casing 2 and/or insulating material in a region of the movable contact and/or the drive rod 3 which drives the movable contact of the vacuum interrupt chamber 1.

According to an exemplary embodiment, the ventilation opening 7 can be formed through the epoxy encapsulating casing 2.

Figure 2:
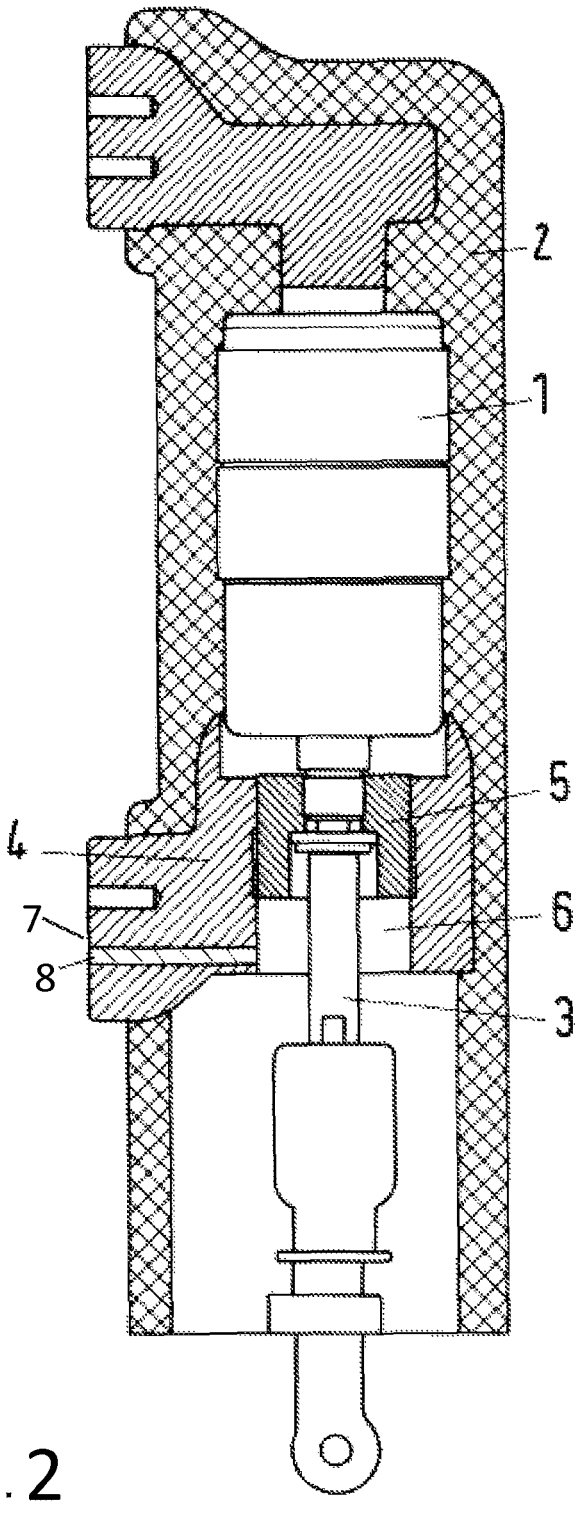
FIG. 2 shows a sectional illustration through an exemplary pole part according to at least one embodiment.

If the ventilation opening 7 is formed through the metallic body of the lower connection point 4, the opening (or openings) to outside the pole part can then also take place by means of hollow screws 8 (denoted by reverse hashing in FIG. 2), which can be screwed into the opening. In this way, no special ventilation opening 7 needs to be drilled. Instead, drilled holes may be provided for accommodating fastening screws for connecting the external busbar. The drilled holes then only need to be partially formed in the lower connection point 4 so as to pass partially through and do not need to be in the form of blind holes, as is otherwise the case in known pole part configurations.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE SYMBOLS

1 Vacuum interrupter chamber
2 Encapsulating casing, insulation
3 Drive rod
4 Connection point, connection piece
5 Piston
6 Cylinder area
7 Ventilation hole
8 Hollow screws

What is claimed is:

1. A pole part of a switching device comprising:

a vacuum interrupter chamber having a fixed contact and a movable contact, the movable contact having an electrical connection piece;

a drive rod configured to drive the movable contact of the vacuum interrupt chamber;

an insulating casing constituted by an insulating material into which the vacuum interrupt chamber is cast, the insulating casing having an opening at a bottom portion in at least one of a region of the movable contact and the drive rod; and at least one ventilation opening formed in at least one of the region of the movable contact and an articulation point of the drive rod, wherein the electrical connection piece extends through the insulating casing and is connectable to a contact external to the insulating casing; and wherein the at least one ventilation opening is formed to pass through at least one of a wall of the insulation casing, a boundary zone between the insulation casing and the electrical connection piece of the movable contact, and the electrical connection piece of the movable contact.

2. The pole part as claimed in claim 1, wherein the ventilation opening is configured to extend substantially at right angles to an actuation axis of a drive axle of the movable contact.

3. The pole part as claimed in claim 1, comprising:

a piston configured to be electrically and fixedly connected to the drive rod;

a cylinder hole formed in the electrical connection piece; and a movable electrical contact connection constituting an electrically conductive connection between the movable contact piece and the electrical connection piece, wherein the movable electrical contact connection is provided via the piston and the cylinder hole, in a piston/cylinder arrangement, and wherein the ventilation opening is formed directly below a lower opening stroke position of the piston.

4. The pole part as claimed in claim 1, wherein a surface of the pole part has at least one of a predetermined amount of surface roughness and a rough structure for improved transport of heat towards at least one of air and gas in at least one of the ventilation opening and the opening of the insulating casing.

5. The pole part as claimed in claim 1, wherein the ventilation opening is formed in a region of an external connection plate of the electrical connection piece.

6. The pole part as claimed in claim 1, wherein:

the ventilation opening is formed in the electrical connection piece by means of at least one continuous hollow screw;

the at least one hollow screw is configured to fix an external contact of the electrical connection piece; and an accommodating opening of the at least one hollow screw is configured to pass continuously from an external surface of the pole part into an interior region of the pole part region to provide ventilation in the pole part.

7. The pole part as claimed in claim 3, wherein the cylinder hole is constituted by a drilled hole through the electrical connection piece.

8. The pole part as claimed in claim 2, comprising:

a piston configured to be electrically and fixedly connected to the drive rod;

a cylinder hole formed in the electrical connection piece; and a movable electrical contact connection constituting an electrically conductive connection between the movable contact piece and the electrical connection piece, wherein the movable electrical contact connection is provided via the piston and the cylinder hole, in a piston/cylinder arrangement, and wherein the ventilation opening is formed directly below a lower opening stroke position of the piston.

9. The pole part as claimed in claim 8, wherein the cylinder hole is constituted by a drilled hole through the electrical connection piece.

10. The pole part as claimed in claim 2, wherein a surface of the pole part has at least one of a predetermined amount of surface roughness and a rough structure for improved transport of heat towards at least one of air and gas in at least one of the ventilation opening and the opening of the insulating casing.

11. The pole part as claimed in claim 3, wherein a surface of the pole part has at least one of a predetermined amount of surface roughness and a rough structure for improved transport of heat towards at least one of air and gas in at least one of the ventilation opening and the opening of the insulating casing.

12. The pole part as claimed in claim 2, wherein the ventilation opening is formed in a region of an external connection plate of the electrical connection piece.

13. The pole part as claimed in claim 3, wherein the ventilation opening is formed in a region of an external connection plate of the electrical connection piece.

14. The pole part as claimed in claim 4, wherein the ventilation opening is formed in a region of an external connection plate of the electrical connection piece.

15. The pole part as claimed in claim 2, wherein:

the ventilation opening is formed in the electrical connection piece by means of at least one continuous hollow screw;

the at least one hollow screw is configured to fix an external contact of the electrical connection piece; and an accommodating opening of the at least one hollow screw is configured to pass continuously from an external surface of the pole part into an interior region of the pole part region to provide ventilation in the pole part.

16. The pole part as claimed in claim 3, wherein:

the ventilation opening is formed in the electrical connection piece by means of at least one continuous hollow screw;

the at least one hollow screw is configured to fix an external contact of the electrical connection piece; and an accommodating opening of the at least one hollow screw is configured to pass continuously from an external surface of the pole part into an interior region of the pole part region to provide ventilation in the pole part.

17. The pole part as claimed in claim 4, wherein:

the ventilation opening is formed in the electrical connection piece by means of at least one continuous hollow screw;

the at least one hollow screw is configured to fix an external contact of the electrical connection piece; and an accommodating opening of the at least one hollow screw is configured to pass continuously from an external surface of the pole part into an interior region of the pole part region to provide ventilation in the pole part.

18. The pole part as claimed in claim 5, wherein:

the ventilation opening is formed in the electrical connection piece by means of at least one continuous hollow screw;

the at least one hollow screw is configured to fix an external contact of the electrical connection piece; and an accommodating opening of the at least one hollow screw is configured to pass continuously from an external surface of the pole part into an interior region of the pole part region to provide ventilation in the pole part.

19. The pole part as claimed in claim 1, wherein the switching device is one of a low-voltage switching device, a medium-voltage switching device, and a high-voltage switching device.

20. The pole part as claimed in claim 1, wherein the at least one ventilation opening is configured to pass air or gas within the bottom portion outside of the pole part to external ambient air.

* * * * *